United States Patent [19]

Perun et al.

[11] Patent Number: 4,589,765

[45] Date of Patent: May 20, 1986

[54] SHEET FEEDER CONTROL FOR REPRODUCTION MACHINES

[75] Inventors: William D. Perun, Webster; Ronald P. Booth, Sr., Pittsford, both of N.Y.

[73] Assignee: Xerox Corporation, Stamford, Conn.

[21] Appl. No.: 736,995

[22] Filed: May 22, 1985

[51] Int. Cl.[4] ..... G03G 15/00

[52] U.S. Cl. ..... 355/3 SH; 355/14 SH; 355/14 R; 430/31; 430/126; 271/182; 271/265; 271/152

[58] Field of Search ..... 355/14 SH, 3 SH, 3 R, 355/14 R, 8; 271/245, 225, 226, 227, 182, 265, 152; 430/31, 126

[56] References Cited

U.S. PATENT DOCUMENTS

| | | | |
|---|---|---|---|
| 4,084,900 | 4/1978 | Yamaoka et al. | 355/14 |
| 4,132,401 | 1/1979 | Gauronski et al. | 271/245 |
| 4,335,949 | 6/1982 | Kukucka et al. | 355/3 R |
| 4,350,439 | 9/1982 | Tanioka et al. | 355/14 SH |
| 4,428,666 | 1/1984 | Phelps et al. | 355/14 SH |
| 4,456,366 | 6/1984 | Komiya et al. | 355/8 |

*Primary Examiner*—A. C. Prescott

*Attorney, Agent, or Firm*—Frederick E. McMullen

[57] ABSTRACT

A reproduction machine with a paper path along which copy sheets are brought one by one into transfer relation with a photoreceptor to receive a developed image, the copy sheets being supplied from either a main or auxiliary paper tray which feeds sheets at a predetermined clock count in synchronization with the operation of the machine, a program permitting the current clock count of a selected tray to be determined and compared with a desired optimum clock count window stored in memory, with adjustment of the clock count made when the current clock count of the selected tray is outside the optimum clock count window to bring paper tray timing within the window, but prevented where the current clock count is outside preset maximum and minimum clock counts.

8 Claims, 11 Drawing Figures

KEEP RUNNING COUNT OF NUMBER OF GOOD READINGS
IS NUMBER OF GOOD READINGS >15 ?
NO
YES
CYCLE DOWN MACHINE
CALCULATE AVERAGE DEPARTURE TIME
ADJUST FEEDER TIMING
END
DISPLAY BAD READING
KEEP RUNNING COUNT OF NUMBER OF BAD READINGS
IS NUMBER OF GOOD READINGS > 2 ?
NO
YES
CYCLE DOWN MACHINE
DISPLAY FAULT

SHEET FEEDER CONTROL FOR REPRODUCTION MACHINES

The invention relates to a reproduction machine or copier, and more particularly to a system for automatically adjusting the copy sheet feeder in accommodation of wear on the feeder parts.

Modern day high speed reproduction machines or copiers rely on critical timing of the various and sundry components that make up the machine to perform the complex copying processes in the shortest possible time and with the greatest measure of reliability. One particularly critical area is the copy sheet supply means which today in many commercial reproduction machines includes both a main paper tray and a smaller auxiliary paper tray. Since for optimum copy quality, exact registration of the copy sheet and the image created on the machine photoreceptor is essential, feeding of the copy sheets from the paper trays must be exact. Further, to enable paper jams to be identified and corrective action taken in the event a jam occurs, sheet jam detectors or sensors are normally disposed at selected points along the path followed by the copy sheet. Since the protection afforded by these sensors is related to the time of arrival or departure of a copy sheet at the sensor, timing of copy sheet feeding must be exact if the sensors are to perform in the manner intended and without creating false alarms.

With normal operation of the reproduction machine, wear and tear may in time degrade the operating efficiency of the various machine components and particularly the copy sheet feeder components. Oftimes, this degradation and wear is not immediately apparent and is not reflected in major or sudden failure in operation, but instead occurs gradually and almost imperceptibly. Notwithstanding, such gradual change or fall off in the operational state of the copy sheet feeder components may individually, or in concert with gradual changes in other related components, work to change the copy sheet feeder timing which in turn may cause slight and potentially unacceptable misregistration of the image on the copy sheet or occasional and sometimes apparently random responses by the jam sensors.

The present invention seeks to obviate the foregoing by providing a method for adjusting the operational timing of the copy sheet feeder in a reproduction machine, comprising the steps of determining the current copy sheet feeding time interval required for the copy sheet feeder to advance a copy sheet to a predetermined point in the copy processing path following actuation thereof by the machine control system; comparing the current copy sheet feeding time interval with an optimum copy sheet feeding time interval stored in the machine memory; and adjusting the sheet feeder timing so that the sheet feeding time interval of the sheet feeder substantially equals the optimum copy sheet feeding time interval stored in the machine memory.

IN THE DRAWINGS

Figure 9A:
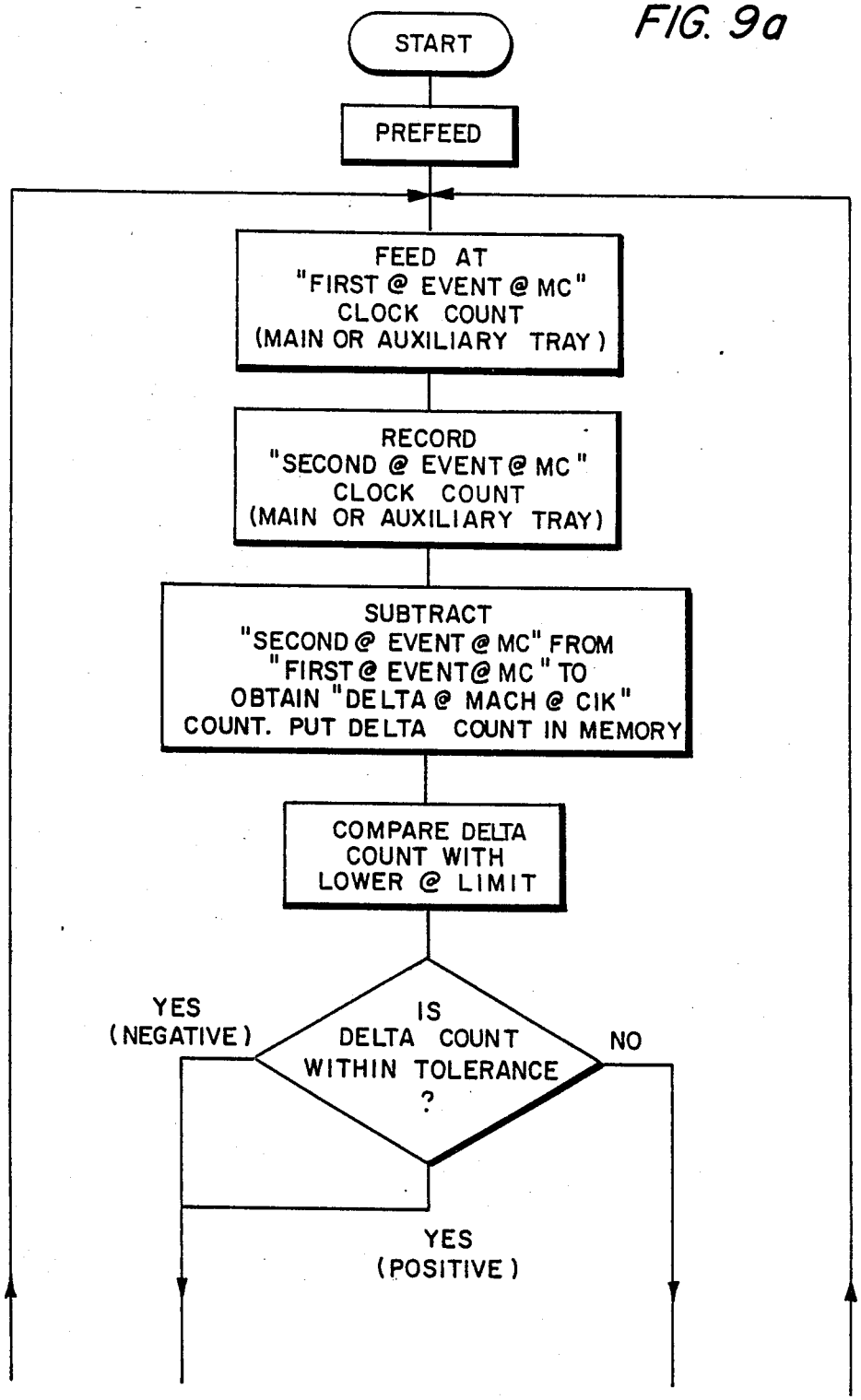
Figure 9B:
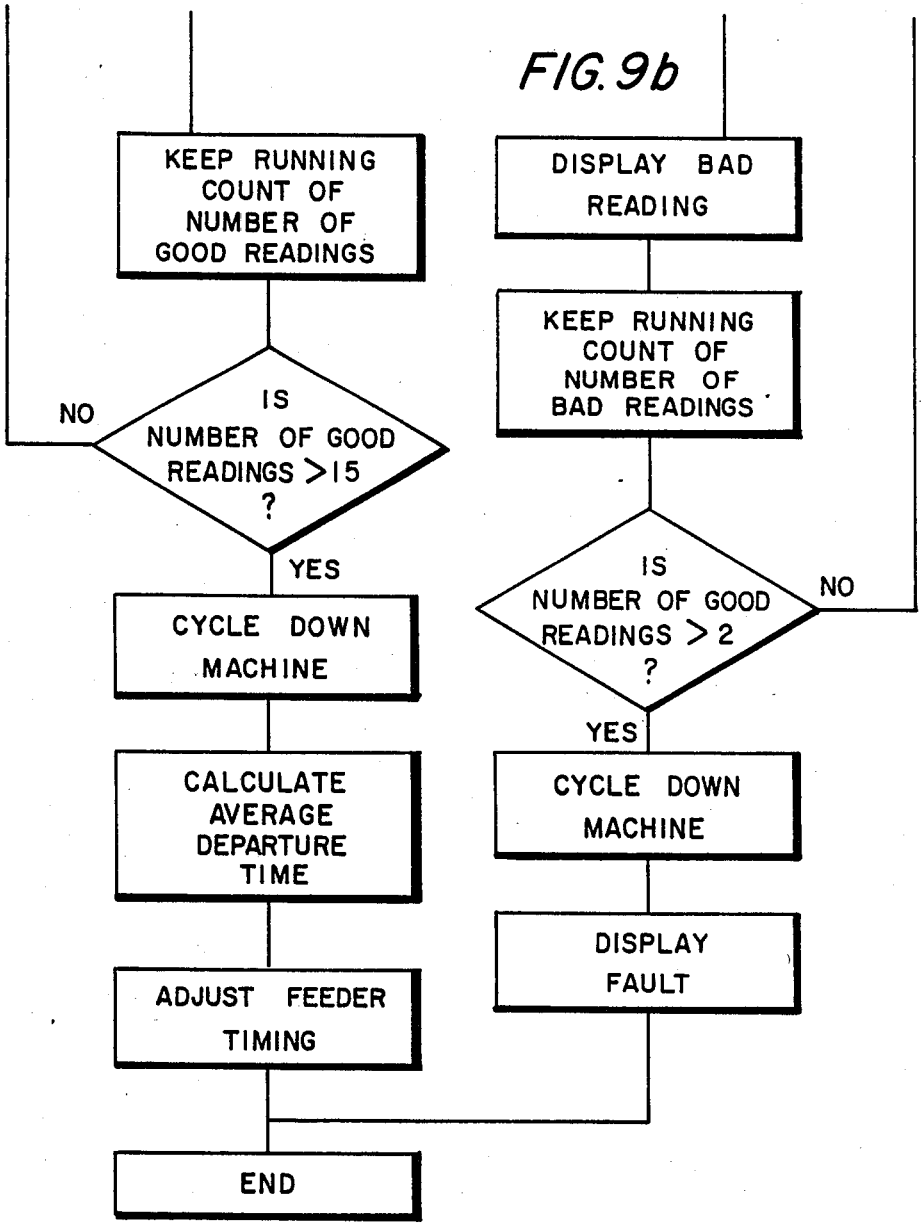
Figure 10:
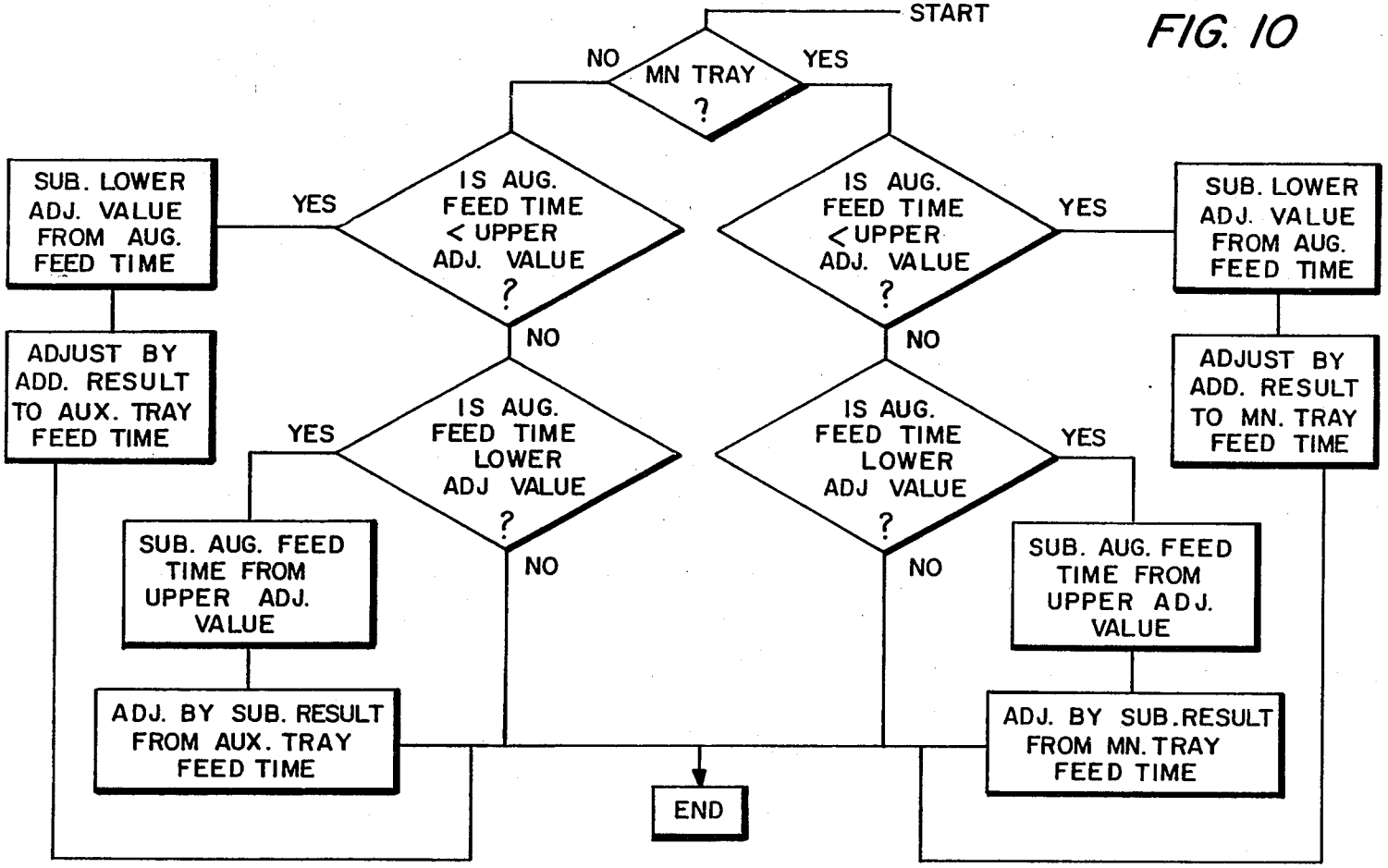

FIGS. 9*a* and 9*b* comprise a flow chart illustrating the steps that comprise the automatic sheet feeder timing control of the present invention; and FIG. 10 is a flow chart illustrating the steps of the routine for adjusting the sheet feeding timing of the main and auxiliary paper trays.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
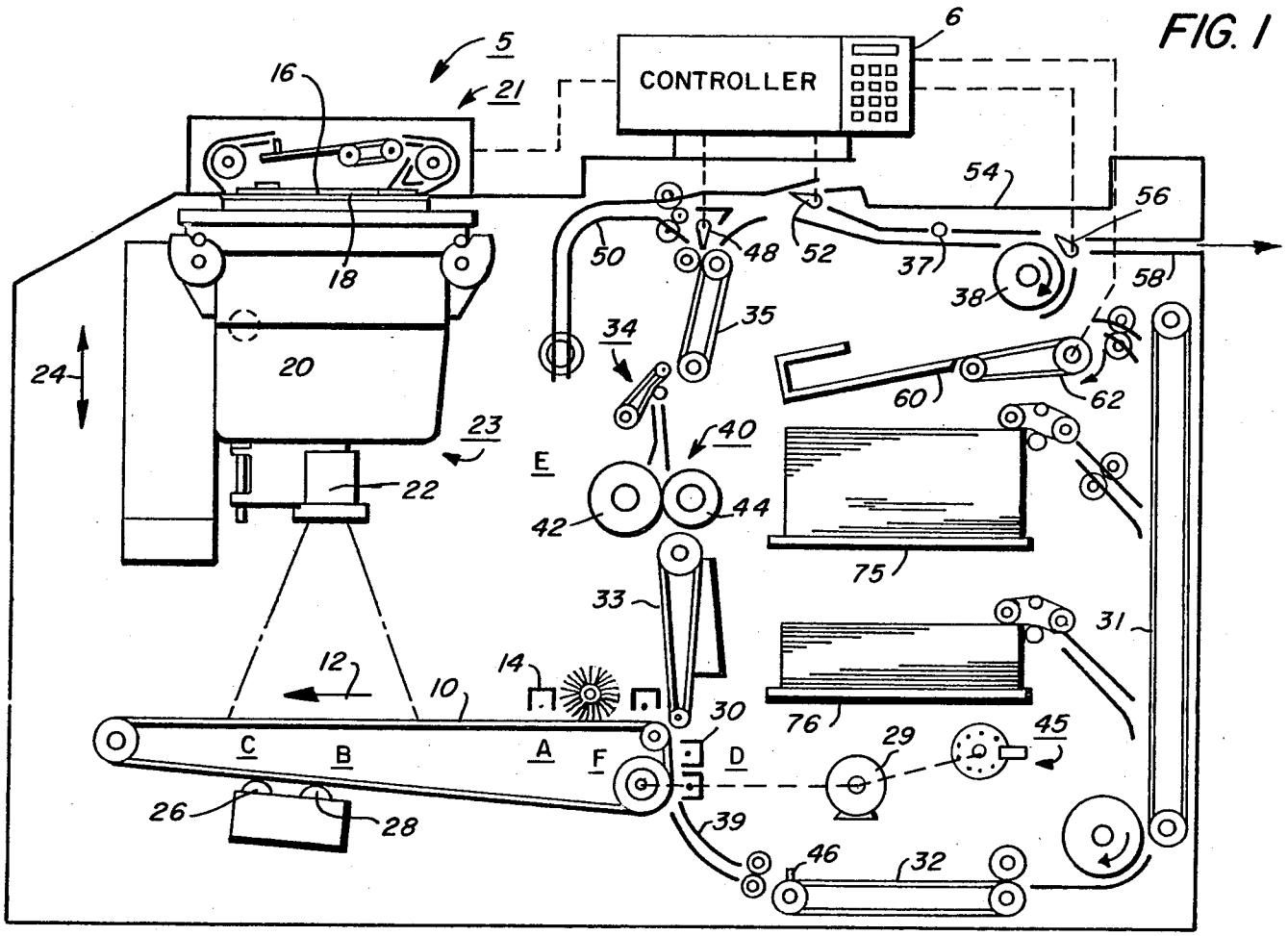
FIG. 1 is a plan view of a reproduction machine incorporating the sheet feeder control of the present invention.

For a general understanding of the features of the present invention, reference is had to the drawings. In the drawings, like reference numerals have been used throughout to designate identical elements. FIG. 1 schematically depicts the varius components of an illustrative electrophotographic printing machine 5 incorporating the wear compensating control of the present invention therein. It will become evident from the following discussion that the invention is equally well suited for use in a wide variety of printing machines and is not necessarily limited in its application to the particular embodiment shown herein.

Inasmuch as the art of electrophotographic printing is well known, the various processing stations employed in the printing machine 5 will be shown hereinafter schematically and their operation described briefly with reference thereto.

Figure 2:
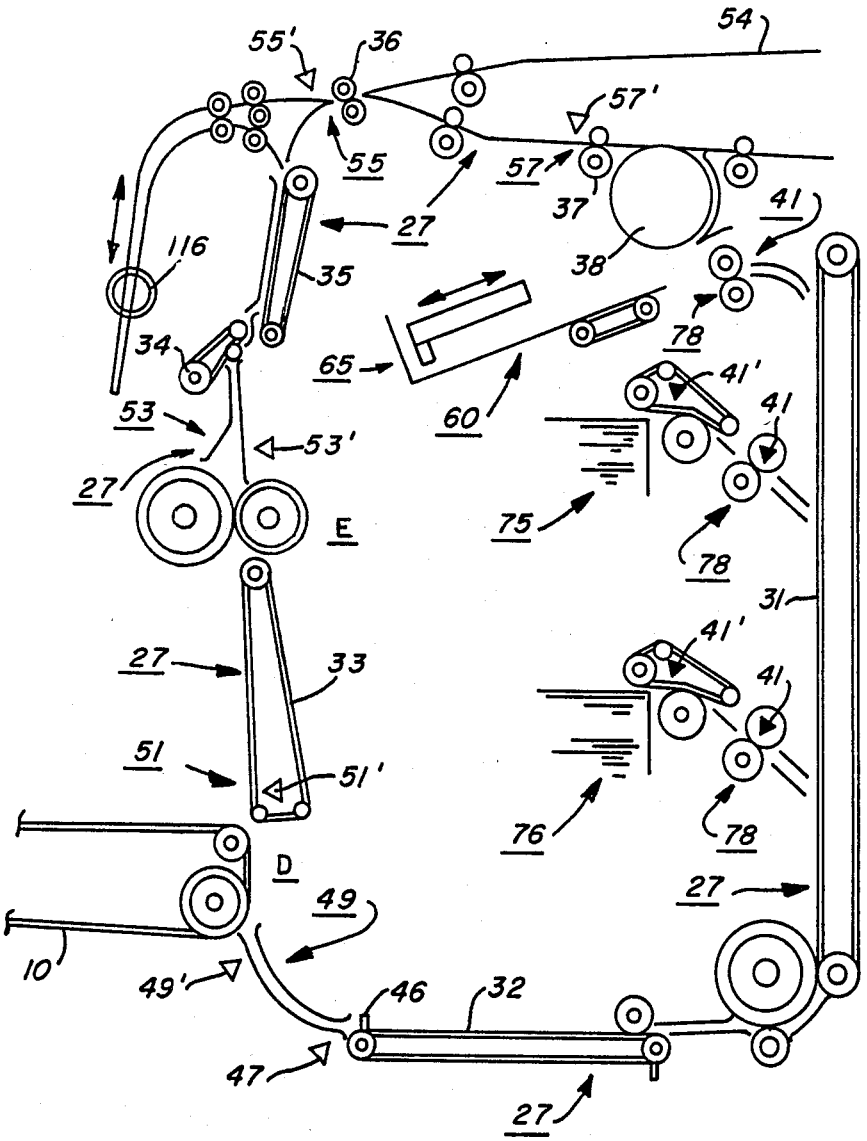
FIG. 2 is a schematic illustration showing details of the reproduction machine paper path.

As shown in FIGS. 1 and 2, the illustrative electrophotographic printing machine 5 employs a belt 10 having a photoconductive surface thereon. Preferably, the photoconductive surface is made from a selenium alloy. Belt 10 is driven by main drive motor 29 and moves in the direction of arrow 12 to advance successive portions of the photoconductive surface through the various processing stations disposed about the path of movement thereof.

Initially, a portion of the photoconductive surface passes through charging station A. At charging station A, a corona generating device, indicated generally by the reference numeral 14, charges the photoconductive surface to a relatively high substantially uniform potential.

Next, the charged portion of the photoconductive surface is advanced through imaging station B. At imaging station B, a document handling unit, indicated generally by the reference numeral 21, positions original documents 16 facedown over exposure system 23. The exposure system includes lamp 20 which illuminates the document 16 positioned on transparent platen 18. The light rays reflected from document 16 are transmitted through lens 22. Lens 22 focuses the light image of original document 16 onto the charged portion of the photoconductive surface of belt 10 to selectively dissipate the charge thereof. This records an electrostatic latent image on the photoconductive surface which corresponds to the informational areas contained within the original document. Thereafter, belt 10 advances the electrostatic latent image recorded on the photoconductive surface to development station C. Platen 18 is mounted movably and arranged to move in the direction of arrow 24 to adjust the magnification of the original document beng reproduced. Lens 22 moves in synchronism therewith so as to focus the light image of original document 16 onto the charged portion of the photoconductive surface of belt 10. While a light/lens type exposure system is illustrated herein, other exposure systems such as scanning laser may be envisioned.

Document handling unit 21 sequentially feeds documents from a stack of documents placed by the operator in a normal forward collated order in a document stacking and holding tray. The documents are fed from the holding tray, in seriatim, to platen 18. The document handling unit recirculates documents back to the stack supported on the tray. Preferably, the document handling unit is adapted to serially sequentially feed the documents, which may be of various sizes and weights of paper or plastic containing information to be copied. The size of the original document disposed in the holding tray and the size of the copy sheet are measured. Preferably, magnification of the imaging system is adjusted to insure that the indicia or information contained on the original document is reproduced within the space of the copy sheet.

While a document handling unit has been described, one skilled in the art will appreciate that the original document may be manually placed on the platen rather than by the document handling unit. This is required for a printing machine which does not include a document handling unit.

A plurality of sheet transports comprising a vertical transport 31, a registration transport 32, prefuser transport 33, decurler 34, post fuser transport 35, output transport 36, bypass transport 37, and inverter roll 38, cooperate with suitable sheet guides 39 to form a paper path 27 through which the copy sheets being processed pass from either main paper supply tray 75, or auxiliary paper supply tray 76, or duplex paper supply tray 60 through the machine 5 to either top tray 54 or discharge path 58. Transports 31, 32, 33, 34, 35, 36, 37, 38 are suitably driven by main drive motor 29. Suitable sheet sensors designated here by the numeral 41, are provided at a wait station 78 the output of each paper tray 75, 76 and at the output of duplex tray 60 to detect feeding of a sheet therefrom.

With continued reference to FIG. 1, at development station C, a pair of magnetic brush developer rollers, indicated generally by the reference numerals 26 and 28, advance a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image to transfer station D. At transfer station D, a copy sheet is moved into transfer relation with the toner powder image. Transfer station D includes a corona generating device 30 which sprays ions onto the backside of the copy sheet. This attracts the toner powder image from the photoconductive surface of belt 10 to the sheet. After transfer, prefuser transport 33 advances the sheet to fusing station E.

Fusing station E includes a fuser assembly, indicated generally by the reference numeral 40, which permanently affixes the transferred powder image to the copy sheet. Preferably, fuser assembly 40 includes a heated fuser roller 42 and backup roller 44. The sheet passes between fuser roller 42 and backup roller 44 with the powder image contacting fuser roller 42. In this manner, the powder image is permanently affixed to the sheet.

After fusing, decurler 34 and post fuser transport 35 carry the sheets to inverter gate 48 which functions as an inverter selector. When energized or pulled, gate 48 directs the copy sheets into a sheet inverter 50. When inoperative, gate 48 bypasses sheet inverter 50 and the sheets are fed directly to bypass gate 52. Thus, copy sheets which bypass inverter 50 turn a 90° corner in the paper path before reaching gate 52. Bypass gate 52 directs the sheets into top tray 54 so that the imaged side which has been transferred and fused is faceup. If inverter 50 is selected, the opposite is true, i.e. the last printed face is facedown. Bypass gate 52 normally directs the sheet into top tray 54 or, when energized, to bypass transport 37 which carries the sheet to duplex gate 56. Gate 56 either directs the sheets without inversion to the discharge path 58 or, when energized, to duplex inverter roll 38. Inverter roll 38 inverts and directs the sheets to be duplexed into duplex tray 60. Duplex tray 60 provides intermediate or buffer storage for those sheets which have been printed on one side and on which an image will be subsequently printed on the side opposed thereto, i.e. the copy sheets being duplexed. Due to the sheet inverting action of inverter roll 38, the buffer set of sheets are stacked in duplex tray 60 facedown in the order in which the sheets have been copied.

In order to complete duplex copying, the previously simplexed sheets in tray 60 are fed seriatim by bottom feeder 62 back via vertical transport 31 and registration transport 32 to transfer station D for transfer of the toner powder image to the opposed side of the sheet. Inasmuch as the bottommost sheet is fed from duplex tray 60, the proper or clean side of the copy sheet is positioned in contact with belt 10 at transfer station D so that the toner powder image thereon is transferred thereto. The duplex sheets are then fed through the same path as the previously simplexed sheets to the selected output for subsequent removal by the printing machine operator.

Figure 3:
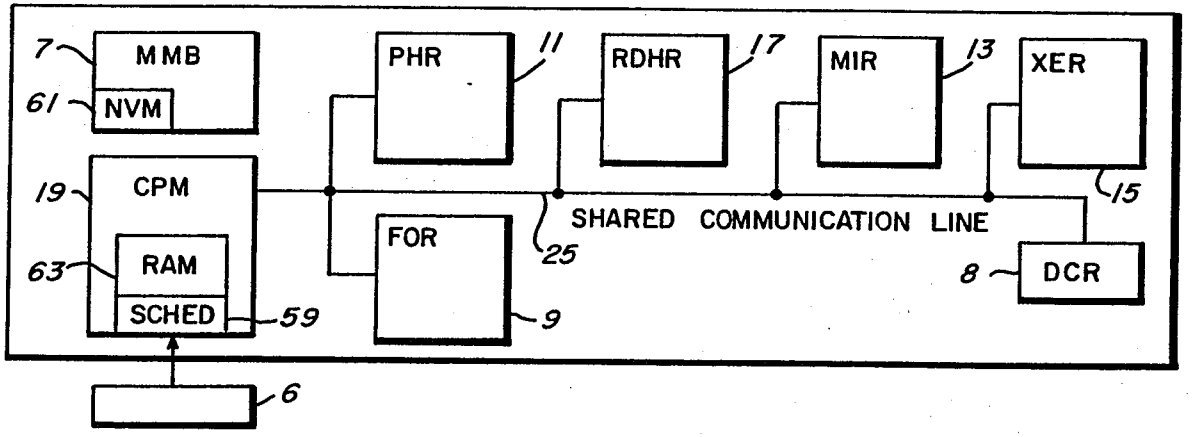
FIG. 3 is a schematic view illustrating the control subdivisions and communication channel for the reproduction machine shown in FIG. 1.

Referring particularly to FIG. 3, reproduction machine 5 is segregated into a series of independent modules (termed remotes herein), and identified as finishing output remote (FOR) 9, paper handling remote (PHR) 11, marking and imaging remote (MIR) 13, xerographic remote (XER) 15, recirculating document handler remote (RDHR) 17, central processing master (CPM) 19 and display control remote (DCR) 8. FOR 9, PHR 11, MIR 13, XER 15, RDHR 17, CPM 19, and DCR 8 are communicated with one another by means of a shared communication line (SCL) 25 through which controlled instructions and synchronizing clock pulse signals from and to the machine remotes pass.

Figure 4:
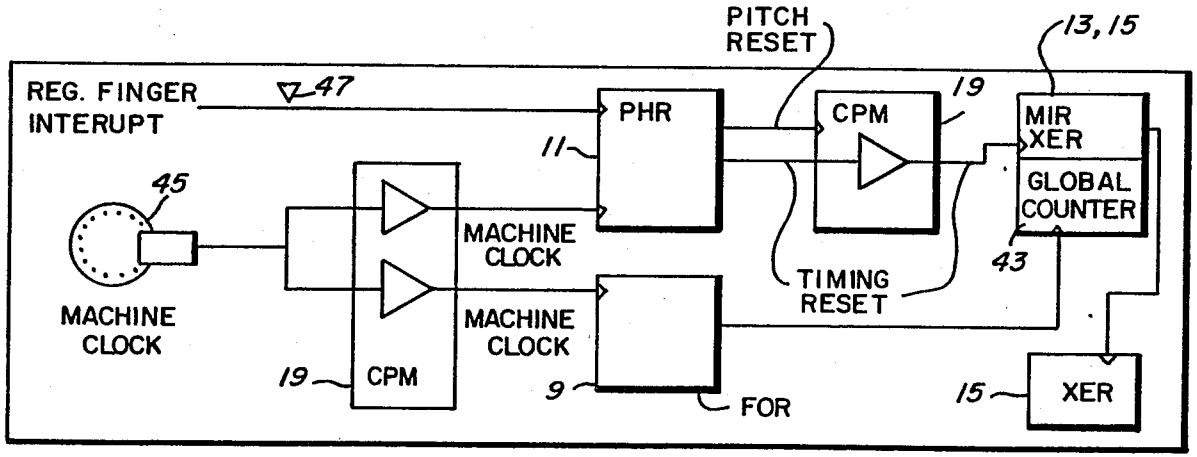
FIG. 4 is a schematic view illustrating the distribution of timing signals to the various control subdivisions for the machine shown in FIG. 1.

Referring particularly to FIGS. 1, 2 and 4, a suitable machine clock 45, which is drivingly coupled to the output shaft of main drive motor 29, generates a succession of clock pulses whenever drive motor 29 is energized. The clock pulse output of machine clock 45 serves to provide timing signals for various components of reproduction machine 5 and for operating a global counter 43. As will be understood, to enhance copy throughput, several copy sheets may be in process at various locations along the paper path at any one time. To accommodate this and permit individual copies to be tracked and processed in the particular manner desired, timing control over the copy processing functions is divided into pitches, each pitch being further subdivided into a number of machine clock pulses. For example, the paper path may be separated into eleven pitches with each pitch being composed of approximately 850 machine clock pulses.

Pitch reset signals, which serve in effect to determine the length of the pitch and the number of machine clock pulses within the pitch, are derived from copy sheet registration finger 46 on registration transport 32. For this purpose, a sensor such as switch 47 is disposed in the path of movement of copy sheet registration fingers 46 such that on each cycle of finger 46 past switch 47, switch 47 outputs a reset signal. The output of machine clock 45 is input through CPM 19 to PHR 11 while the pitch reset signals generated by switch 47 are input directly to PHR 11.

Referring particularly to FIG. 2, to monitor and control movement and processing of the copy sheets moving along the paper path, a series of sensors which may for example comprise switches, are disposed at predetermined jam detection stations along the paper path. More specifically, a pretransfer jam detection station 49 is provided upstream of transfer station D having sheet sensor 49', a pre-fuser jam detection station 51 is provided upstream of fusing station E having sheet sensor 51', a post-fuser jam detection station 53 is provided on the downstream side of fusing station E having sheet sensor 53', an output transport jam detection station 55 is provided at the inlet to output transport 36 having sheet sensor 55=, and a bypass jam detection station 57 is provided in the bypass transport 37 upstream of duplex inverter roll 38 having sheet sensor 57'.

Referring particularly to FIGS. 1 and 3 of the drawings, to enable the user or operator of reproduction machine 5 to control the machine and program the copy run desired, a suitable operator control panel 6 is provided at some convenient location on machine 5. CPM 19 includes a scheduler 59 for scheduling processing of each copy, the copy run instructions programmed through control panel 6 being input to scheduler 59. As will be understood by those skilled in the art, there is also provided a suitable memory section, exemplified herein by Main Memory Board (MMB) 7 (shown in FIG. 3). MMB 7 normally includes both Read Only Memory (ROM) and Random Access Memory (RAM), and non-volatile memory or NVM 61 wherein data representing the particular machine configuration parameters (i.e. document handler type) and operating parameters (i.e. exposure timing) is stored. Additionally, CPM 19 includes on-board memory such as RAM memory 63. Scheduler 59 responds to the copy run information input by the operator through control panel 6 and the machine configuration and operating parameters input from NVM 61 to generate a copy information byte (COPY@INFO) for each copy to be made.

Each copy information byte contains data identifying the copy sheet source (i.e. tray 75, 76, or 60), the copy destination (i.e. top tray 54, FOR 9, or duplex tray 60), whether the copy is to be inverted or not (i.e. by inverter 50), whether the copy represents the end of the set (i.e. the last copy of a batch), if the sheet is a clearing or purge sheet (normally as a result of a paper jam), and image information related to the particular copy being made (i.e. feed or not feed a sheet). The copy information byte is entered in RAM 63 of CPM 19 and there held in a suitable memory location or variable, the latter being defined herein as a location in memory where information is stored. During copy processing, the copy information byte is moved from one memory variable to another memory variable in synchronism with movement of the copy sheet along the paper path from the paper tray in use (i.e. 75, 76, or 60) to the first jam detection station 49, from the first jam detection station 49 to the next or second jam detection station 51, and so forth and so on until the copy process specified by the copy information byte is completed. The copy information byte is read at each jam detection station to provide further operating instructions to the machine 5 for processing the copy sheet to the next jam detection station, etc.

Figure 5:
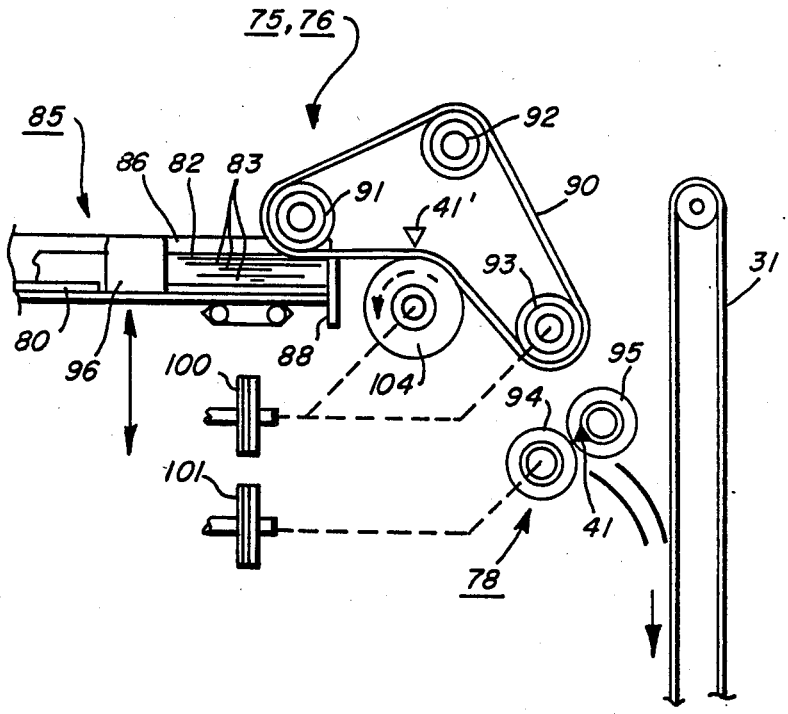
FIG. 5 is a fragmentary elevational view showing details of the main and auxiliary paper trays for the reproduction machine shown in FIG. 1.
Figure 6:
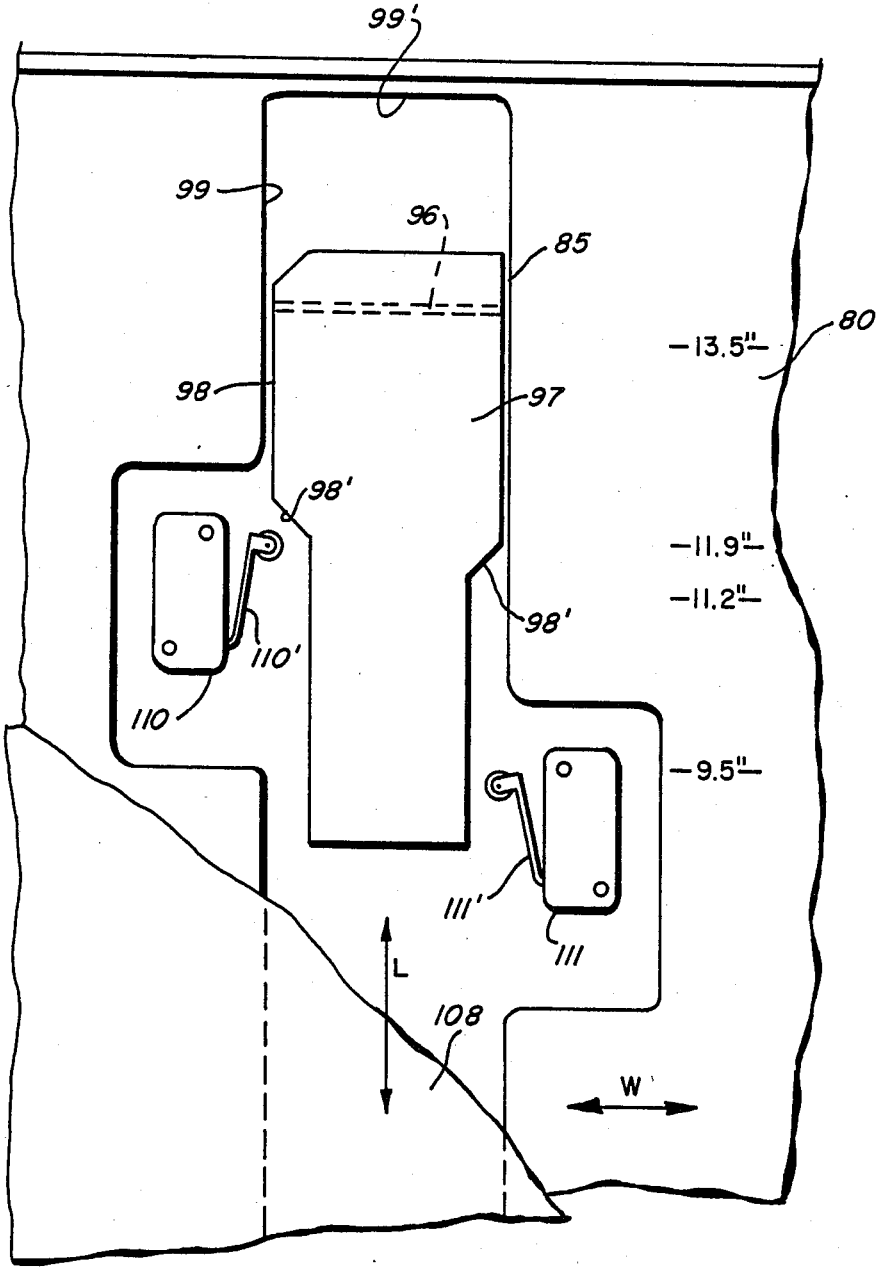
FIG. 6 is a bottom plane view showing details of the adjustable side guide for the paper trays shown in FIG. 5.

Referring to FIGS. 5 and 6 of the drawings, main and auxiliary paper trays 75, 76 respectively each include a sheet elevator or base 80 onto which a stack-like supply 82 of copy sheets 83 may be placed for use by the reproduction machine 5. A sheet stop 88 locates the copy sheets in the sheet feed direction. A sheet feeder in the form of an endless belt 90 supported for movement upon rollers 91, 92, 93 such a portion of belt 90 engages the topmost one of the copy sheets on base 80, is provided. A Take Away Roll (TAR herein) pair 94, 95 is provided in the discharge path of belt 90 at wait station 78, wait station 78 being operatively disposed between belt 90 and the inlet to vertical transport 31 of paper path 27. Belt 90 and TAR pair 94, 95 are driven from main drive motor 29 through clutches 100, 101 respectively.

To prevent feeding of multiple copy sheets at once, a retard roll 104 is provided, roll 104 cooperating with an intermediate portion of belt 90 to form a nip between which the copy sheets are fed. Retard roll 104 is driven by suitable drive means (not shown) at an extremely low speed in a direction opposite to the direction of movement of belt 90 (as shown by the dotted line arrow in FIG. 5) to limit feeding of copy sheets to one sheet at a time. Sheet sensor 41 is provided adjacent TAR pair 94, 95 to detect the presence or absence of a copy sheet at wait station 78.

Main and auxiliary paper trays 75, 76 each are provided with side guides 85, 86. In the exemplary arrangement shown, side guide 85 is adjustable to permit the effective size of the paper trays 75, 76 to be set to the length L the copy sheets being processed. As will appear, adjusting movement of side guide 85 is along an axis substantially normal to the direction of copy sheet feed. While side guide 85 is shown and described herein as being adjustable, guide 86 or both guides 85, 86 may be made adjustable.

Side guide 85 is substantially L shaped when veiwed in cross-section, the upright portion 96 thereof forming a register edge or guide for locating, in cooperation with guide 86, the copy sheets placed in the paper tray 75 or 76. The bottom section 97 of guide 85 is slideably disposed within a longitudinally extending slot like opening 99 formed between the base 80 of the paper trays 75, 76 and lower cover 108. This enables guide 85 to be manually slid back and forth along an axis substantially normal to the direction in which copy sheets are fed to adjust the size of the paper trays 75, 76 in accordance with the size copy sheets being processed. A pair of sensors in the form of switches 110, 111 are provided on either side of the path of movement of section 97 of guide 85, switches 110, 111 serving to sense the position of guide 85. For this purpose, arms 110', 111' of switches 110, 111 are spring biased outwardly and ride against the opposing sides 98 of guide section 97, sides 98 being configured in the form of cams for selectively actuating switches 110, 111 in response to the disposition of side guide 85. For this purpose, sides 98 have relief or cutout segments 98' of predetermined length to define predetermined positions of guide 85. Switches 110, 111 accordingly serve to generate a signal identifying the current position of side guide 85.

In the arrangement shown, adjustments for four copy sheet sizes are provided, namely for a first copy sheet length ranging between 9.5" and 11.2" in which switch 111 is closed, for a second sheet length ranging between 11.2" and 11.9" in which both switches 110, 111 are closed, for a third copy sheet length ranging between 11.9" and 13.5" in which switch 110 is closed, and for a fourth sheet length in excess of 13.5" in which both switches 110, 111 are open.

To enable the width W of the current copy sheets in tray 75 or 76 to be determined, sheet width dimensions W corresponding to the different sheet lengths L are stored in NVM 61. The signal output of switches 110, 111, which as explained above identifies the position and hence the length L of the copy sheets in the trays, form an address for addressing the sheet width dimensions stored in NVM 61.

Referring to drawing FIGS. 1–7, depressing the reproduction machine Start/Print button following programming of a copy run by the operator or user actuates machine 5 to produce copies of the document original or originals being copied. With actuation of reproduction machine 5, main drive motor 29 is energized to operate, together with other machine components, the various sheet transport devices that comprise main paper path 27 preparatory to feeding of copy sheets from the main or auxiliary paper tray selected along paper path 27. With energization of drive motor 29, machine clock 45 commences to generate an endless stream of clock pulses (FEED CLOCK COUNT). The stream of clock pulses output by clock 45 is in turn subdivided into blocks of clock pulses by the reset signals (PITCH RESET) generated by sensor 47 with operation of registration transport 32 and attendant movement of registration fingers 46.

Figure 7:
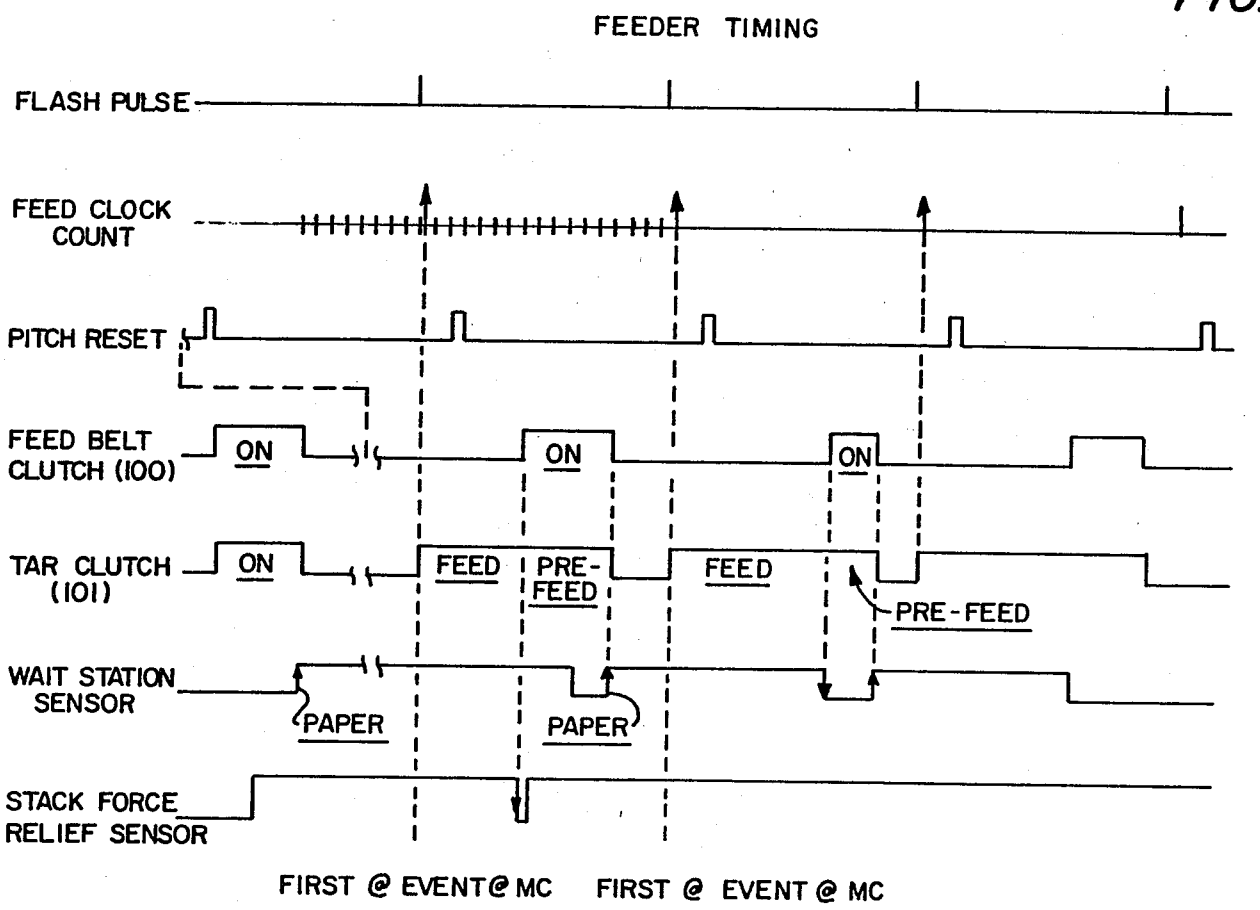
FIG. 7 is a timing chart showing exemplary timing relations for the copy sheet feeder components and reproduction machine.

Referring now particularly to FIGS. 5 and 7 and Table I, the prefeed cycle is entered in which PHR 11 (referred to as PHM or Paper Handling Module in the Table) is cycled up to advance the first sheet in the paper tray selected, i.e. main or auxiliary paper tray 75 or 76, forward to the paper tray wait station 78 (i.e. START PRF-MN-FDR, or START PRF-AUX-FDR). Clutches 100, 101 of the selected paper tray are energized to operate sheet feed belt 90 and TAR roll pair 94, 95 and advance the topmost sheet 83 in the stack of sheets 82 forward toward wait station 78. As the first sheet of copy paper moves forward to wait station 78, the presence of the sheet is detected by relief sensor 41' (STACK FORCE RELIEF SENSOR) and thereafter by sheet sensor 41 (WAIT STATION SENSOR), the signal from the latter on detection of the copy sheet leading edge terminating energization of clutches 100, 101. CPM 19 responds to the signal from sensor 41 to disengage clutches 100, 101 to terminate the prefed cycle. As a result, the copy sheet is disposed in a partially fed position (at wait station 78) pending demand therefor.

Subsequently, on a predetermined reset/clock pulse combination (FIRST@EVENT@MC), TAR clutch 101 is actuated to operate TAR pair 94, 95 and advance the prefed copy sheet forward from wait station 78 to vertical transport 31 and into the main paper path 27. As the trailing edge of the copy sheet passes over relief sensor 41' (STACK FORCE RELIEF SENSOR), the signal output of sensor 41' actuates clutch 100 to operate feed belt 90 and commence advance of the next copy sheet 83 from stack 82 forward to wait station 78 (presuming another copy is to be made). TAR clutch 101 remains energized through this period to enable prefeeding of the next copy sheet. On detection of the copy sheet leading edge by wait station sensor 41, the signal from sensor 41 deenergizes clutches 100, 101 to terminate feeding of the next copy sheet with the copy sheet in position at wait station 78.

The foregoing process is repeated for each copy processed. At the completion of the copy run programmed, machine 5 cycles down.

As can be understood, timing of feeding of the copy sheet from main and auxiliary paper trays 75, 76 respectively is critical if exact registration of the image developed on the photoconductive surface 10 is to be maintained. It will also be appreciated that with time and use, the operational timing of main and auxiliary paper trays 75, 76 may change.

Figure 8:
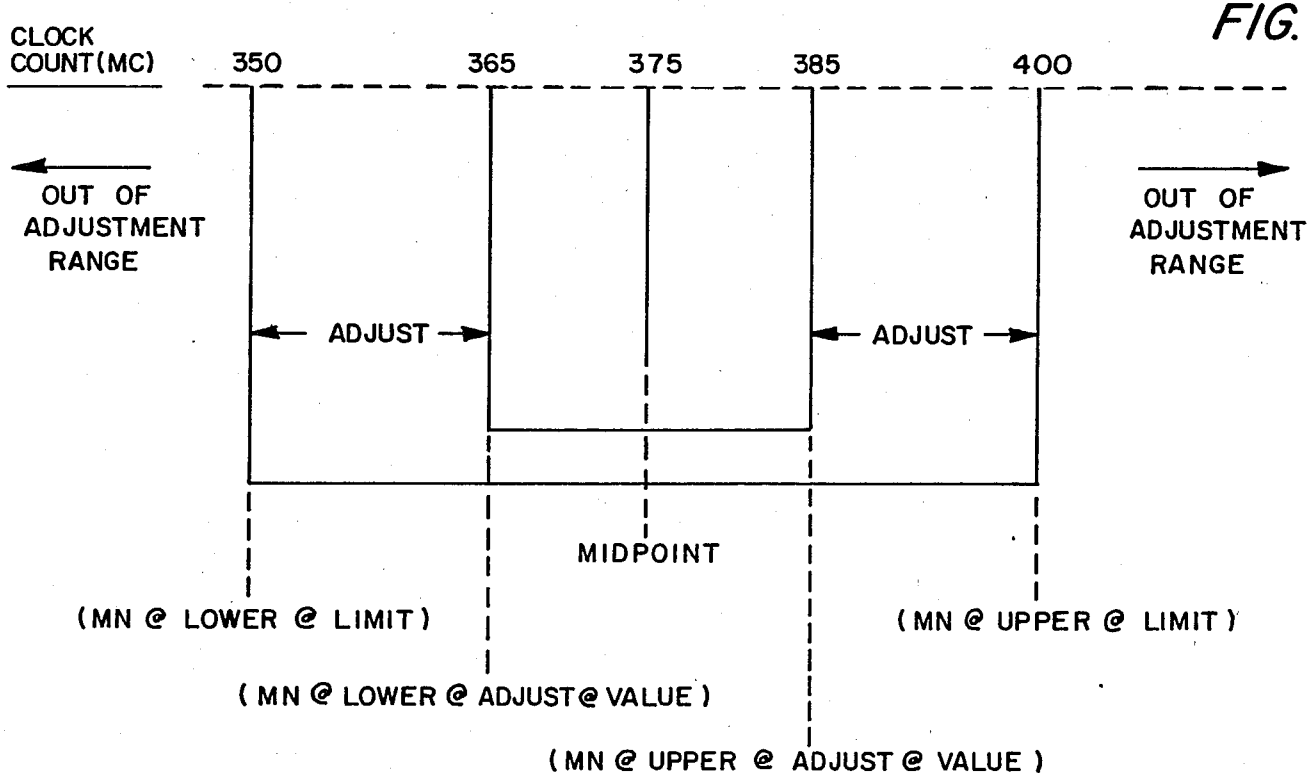
FIG. 8 is a graph showing an exemplary set of sheet feeding timing parameters for the main paper tray.

Referring now to FIG. 8, there is shown exemplary sheet feed timing parameters in the form of machine clock counts (MC) for main paper tray 75. As can be seen, there is an optimum clock count timing window for tray 75 between a clock count of 365 (referred to as MN@LOWER@ADJUST VALUE) and a clock count of 385 (referred to as MN@UPPER@ADJUST VALUE). As will appear, no timing adjustments are required when the main paper tray is determined to be operating within this optimum clock count window.

A permissible adjustment window on either side of the optimum window exists. On the lower side, the adjustment window falls between clock counts 350 (MN@LOWER@LIMIT) and 365 (MN@LOWER-@ADJUST@VALURE) while on the upper side the adjustment window falls between clock counts 385 (MN@UPPER@ADJUST@VALUE) and 400 (MN@UPPER@LIMIT). Where the clock count falls within this adjustment window, adustment of the main paper tray timing can be made. In this connection, it will be understood that the range of adjustment or tolerance is determined not only by the range of adjustment possible with the paper tray but also by the range of adjustments that can be made to other related operating components and parts of the reproduction machine 5.

Where the clock count is either below or above the adjustment window, i.e. less than 350 or greater than 400, the paper tray timing has gone beyond the range of adjustment. In that case, servicing, which may include replacement or repair of not only components in the main paper tray but of related components of the reproduction machine is generally necessary.

As will be understood, a similar set of timing parameters exist for auxiliary tray 76.

During routine servicing of reproduction machine 5, the service man (referred to herein as a Tech Rep) may call up the service program shown in Table II and the flow chart of FIGS. 9*a* and 9*b* to check, and if necessary, adjust the timing of main and auxiliary paper trays 75, 76, or determine that the paper tray being checked is out of the range of adjustment and hence that service and repair the machine is required. In this routine, the Tech Rep selects through control panel 6 the paper tray, i.e. either main paper tray 75 or auxiliary paper tray 76 whose timing is to be checked. In the ensuing description, the selected tray is presumed to be main paper tray 75.

Thereafter, on actuation of machine 5, a copy sheet is prefed by main paper tray to the wait station 78 as described heretofore. Subsequent actuation of TAR pair 94, 95 on a predetermined sheet feed clock count (FIRST@EVENT@MC) feeds the copy sheet forward form wait station 78 to vertical transport 31 and into the main paper path 27 as described earlier. The sheet feed clock count (FIRST@EVENT@MC) is stored in RAM 63. As the trailing edge of the copy sheet passes sensor 41, the current count of machine clock 45 (SECOND@EVENT@MC) is read and entered in RAM 63. The first and second clock counts are then differenced to produce a delta clock count (DELTA@MACH@CLK=SECOND@EVENT@MC-FIRST@EVENT@MC).

In the ensuing explanation, it is presumed that the delta clock count is negative, i.e. below the midpoint of the optimum clock count window. In the example shown in FIG. 8, the optimum clock count window midpoint is 375. In the example being considered therefore, feeding of the copy sheet is retarded to some degree. While a negative delta clock count condition is described, it will be understood that the delta clock count may instead be positive, that is, above the midpoint of the optimum clock count window.

The delta clock count is compared with the preset clock count limit (LOWER@LIMIT) to determine if the delta count is within the predetermined tolerance within which adjustment of the main paper tray can be made (IF DELTA@MACH@CLK-LOWER@LIMIT<TOLERANCE). Where the delta count is within tolerance (IF (DELTA@MACH@CLK-LOWER@LIMT)<TOLERANCE THEN BEGIN), additional readings are taken. For this purpose, actuation of the main paper tray feeder is repeated and a running count is maintained of the number of successive good readings. When a predetermined number readings (i.e. 16) are obtained (IF MODFEED@CT>15 THEN BEGIN,) reproduction machine 5 is cycled down (START REQUEST-CYCLEDOWN) and the departure time from the optimum clock count window of the several good readings is averaged (DIVIDE WORD (MSB(TOTAL@FEED@TM), LSB(TOTAL@FEED@TM),0,16) RETURNS MSB(AVG@FEED@TM), LSB(AVG@FEED@TM). The Adjust Feed Time routine of Table III and FIG. 10 of the drawings is now entered.

Where the average feed time (AVG@FEED@TM) is within the optimum clock count window, no adjustment of the main paper tray feed timing is made. Where the averaged feed time is less than the main tray upper adjusting value (IF AVG@FEED@TM<MN@UPPER@ADJUST@VALUE), the degree of adjustment (ADJUSTING@VALUE) is obtained by subtracting the lower adjusting value from the averaged feed time (ADJUSTING@VALUE←(AVG@FEED@TM-MN@LOWER@ADJUST@VALUE). The main tray feed timing is then reset by adding the adjusted value obtained to the main tray feed timing (MN@FEED@TIME←(MN@FEED@TIME+ADJUSTING@VALUE) and storing the new value in RAM 63.

Where the averaged feed time is greater than the main tray upper adjusting value (IF AVG@FEED@TIM>MN@LOWER@ADJUST@VALUE), the degree of adjustment required (ADJUSTING@VALUE) is obtained by subtracting the averaged feed time from the upper adjusting value (ADJUSTING@VALUE←(MN@UPPER@ADJUST@VALUE-AVG@FEED@TM). The main tray feed timing is then reset by subtracting the adjusted value obtained from the main tray feed timing (MN@FEED@TIME←(MN@FEED@TIME-ADJUSTING@VALUE) and storing the new value in RAM 63.

In the example shown in FIG. 8, where the delta count is 20 or less (i.e. 385–365), no adjustment is made. Where the delta count is between 20 and 50 on either the lower or upper side, adjustments are made to the machine 5 to bring the timing of the paper tray being checked within the optimum clock count window.

Referring again to Table II and drawing FIGS. 9*a* and 9*b*, where the delta clock count is outside the adjustment window, i.e. greater than 50, the bad reading is displayed and the number of bad readings recorded. Where the number of successive bad readings is less than a predetermined number (IF FEED@FLT@CT>2 THEN BEGIN), the main tray paper feeder is actuated again. When the number of successive bad readings equal a predetermined number (i.e. 3), reproduction machine is cycled down (START REQUEST-CYCLEDOWN) and the fault displayed, the latter indicating the main tray sheet feeder component or components to be repaired or replaced.

While the invention has been described with reference to the structure disclosed, it is not confined to the details set forth, but is intended to cover such modifications or changes as may come within the scope of the following claims.

TABLE I

| | |
|---|---|
| GLOBAL PROCEDURE: CYCLUP-PHM (CYCLEUP,BYTE) | |
| HP FILE NAME: | CYUPPH:RB |
| RESPONSIBLE ENGINEER: | RON BOOTH |
| OUTPUT FILENAME: | B,CYUPPH |
| PDL SEGMENT NAME: | CYCLE UP PHM |
| DESCRIPTION: | THE PAPER HANDLING MODULE IS CYCLED_UP BY THIS PROCEDURE WHN START PRINT IS PUSHED |
| VERSION/LINK LEVEL | A00 304 |
| STARTED BY: | PROCEDURE INIT-SYSTEM |
| PASSED: | NOTHING |
| RETURNS: | NOTHING |
| ENTER: | |
| IF (DIAG@SETRUP@INHIBITS & FEED@MASK)=CLEAR,THEN BEGIN, | |
| IF (SIDE@−1=SIDE 2) (PURGE@PATH=TRUE) THEN BEGIN, | |

TABLE I-continued

```
IF JOB@SELECTION (TRAY)=MAIN THEN BEGIN,
START PRF_MN_FDR,
END,
ELSE BEGIN;
START PRF_AUX_FDR,
END,
END,
IF JOB@SELECTION (FORMAT)=SIM@DUP JOB@SELECTION (FORMAT)=DUP@DUP
THEN BEGIN,
DUP$MTRS ON.
```

TABLE II

```
ENTER
/*CALL*/
PHR_DIGITAL_MC(IO_VAL(PITCH#RESET,TRUE@)) RETURN        (get global mach.clock
MSB(FIRST@EVENT@MC),LSB(FIRST@EVENT@MC),                count of pitch reset
IF TRAY=MAIN THEN BEGIN,                                pulse,FIRST@EVENT@MC)
/*CALL*/
PHR_DIGITAL)MC(IO_VAL(MAIN#WT,NO@PAPER))RETURNS         (get global mach. clock
MSB (SECOND@EVENT@MC), LSB (SECOND@EVENT@MC)            count of sheet
LOWER@LIMIT<-MN@LOWER@LIMIT                             departure from wait
END,/*IF*/                                              station,2ND@EVENT@MC)
ELSE BEGIN,                                             OR
WAIT 100 MC,
/*CALL*/
PHR_DIGITAL)_MC(IO_VAL(AUX@WT,NO@PAPER))RETURNS         (get global mach. clock
MSB(SECOND@EVENT@MC),LSB(SECOND@EVENT@MC)               count of sheet depart-
LOWER@LIMIT<-AX@LOWER@LIMIT,                            ure from wait station,
END, /*ELSE*/                                           SECOND @EVENT@MC)
IF (DELTA@MACH@CLK<-
(SECOND@EVENT@MC-FIRST@EVENT@MC),
IF (DELTA@MACH@CLK-LOWER@LIMIT)<
TOLERANCE,THEN BEGIN,
TOTAL@FEED@TM<-(TOTAL@FEED@TM+DELTA@MACH@CLK)           (check if calculation
MODFEED@CT<-MODFEED@CT+1,                               is within tolerance,
IF MODFEED@CT>15,THEN BEGIN, /*16*/                     keep a running total of
START-REQUEST_CYCLEDOWN (SOFTDOWN)                      good readings, count
CANCEL MN_FEED1,                                        number of good readings,
CANCEL AUX_FEED1,                                       MODFEED@CT. If
/*CALL*/                                                required number of good
DIVIDE_WORD (MSB(TOTAL@FEED@TM),                        readings is reached.
LSB (TOTAL@FEED@TM)0,16                                 then cycle down
RETURNS MSB(AVG@FEED@TM),LSB(AVG@FEED@TM),              machine.)
START MC_RT_MEASUREMENTS (AVG@FEED@TM),                 (Calculate an average
MODFEED@CT,FEED@FLT@CT,MSB(TOTAL@FEED@TM),              departure time,
LSB(TOTAL@FEED@TM) 0                                    AVG@FEED@TM)
END; /*IF*/
ELSE BEGIN
START MC_RT_MEASUREMENTS (DELTA@MACH@CLK),              (Reading is out of
FEED@FLT@CT<-(FEED@FLT@CT+1)                            tolerance, display bad
IF FEED@FLT@CT>2 THEN BEGIN;/*3*/                       reading, count number
START REQUEST_CYCLEDOWN (SOFTDOWN),                     of bad reading. If
CANCEL MN_FEED1,                                        too many bad readings
CANCEL AUX_FEED1,                                       cycle down machine.)
START MC_RT_,MEASUREMENTS (ERRATICO@FDR),               (Display need for
FEED@FLT@CT,MODEFEED@CT,MSB(TOTAL@FEED@TM),             machine repair.)
LSB(TOTAL@FEED@TM)<-0
END; /*IF*/
END; /*ELSE*/
END; /*ENTER*/
```

TABLE III

ADJUST FEED TIME

```
IF TRAY = MAIN, THEN BEGIN;
IF AVG@FEED@TM<MN@UPPER@ADJUST@VALUE, THEN BEGIN;
IF AVG@FEED@TM>MN@LOWER@ADJUST@VALUE, THEN BEGIN;
/*AVG@FEED@TM IS ALRIGHT AS IS */
END
ELSE BEGIN;/*FEED TIME NEEDS TO BE LATER*/
ADJUSTING@VALUE←(AVG@FEED@TM-MN@LOWER@ADJUST@VALUE)
MN@FEED@TIME←(MN@FEED@TIME + ADJUSTING@VALUE)
END;
END;
ELSE BEGIN;/*FEED TIME NEEDS TO BE SOONER*/
ADJUSTING@VALUE←(MN@UPPER@ADJUST@VALUE - AVG@FEED@TM)
MN@FEED@TIME←(MN@FEED@TIME - ADJUSTING@VALUE)
END;
END;
```

TABLE III-continued

| ADJUST FEED TIME |
|---|
| ELSE BEGIN;/*AUX TRAY*/ |
| IF AVG@FEED@TM<AUX@UPPER@ADJUST@VALUE, THEN BEGIN; |
| IF AVG@FEED@TM>AUX@LOWER@ADJUST@VALUE, THEN BEGIN; |
| /*AVG@FEED@TM IS ALRIGHT AS IS */ |
| END; |
| ELSE BEGIN;/*FEED TIME NEEDS TO BE LATER*/ |
| ADJUSTING@VALUE←(AVG@FEED@TM - AUX@LOWER@ADJUST@VALUE) |
| AUX@FEED@TIME←(AUX@FEED@TIME + ADJUSTING@VALUE |
| END; |
| ELSE BEGIN;/*FEED TIME NEEDS TO BE SOONER*/ |
| ADJUSTING@VALUE←(AUX@UPPER@ADJUST@VALUE - AVG@FEED@TM) |
| AUX@FEED@TIME←(AUX@FEED@TIME - ADJUSTING@VALUE) |
| END; |
| END. |

We claim:

1. In a method for operating a reproduction machine of the type which produces copies of originals on copy sheets supplied by at least one copy sheet feeder, said reproduction machine including a copy processing path along which said copy sheets are transported when processing copies; memory means for storing operating parameters for actuating the components of said machine including said sheet feeder in selective fashion to produce copies; clock means for generating clock counts for operating said components in predetermined timed relation; and control means for operating said machine to produce copies in accordance with the copy run programmed; said sheet feeder including a tray for holding a supply of copy sheets and sheet transport means actuable on a predetermined one of said clock counts to feed one of said copy sheets to said copy processing path; comprising the steps of:

(a) measuring the current sheet feeding interval required for said sheet feeder to deliver a copy sheet to said copy processing path following actuation thereof;

(b) comparing said current sheet feeding interval with an optimum sheet feeding interval stored in said memory means; and (c) adjusting said predetermined one clock count so that said current sheet feeding interval is substantially equal to said optimum sheet feeding interval.

2. The method according to claim 1 including the steps of:

(a) establishing maximum upper and lower clock count limits for actuating said sheet feeder, and (b) interrupting operation of said machine in the event said predetermined one clock count exceeds one of said maximum upper or lower clock counts.

3. The method according to claim 1 including the steps of:

recording the clock count on actuation of said sheet feeder;

recording the clock count when the copy sheet being fed reaches a preset position;

differencing said clock counts to provide a delta count representative of said current sheet feeding interval;

comparing said delta count with a count representing said optimum sheet feeding interval to provide a control count; and adjusting said one predetermined clock count by said control count so that the sheet feeding interval of said sheet feeder is substantially equal to said optimum sheet feeding interval.

4. The method according to claim 3 including the steps of:

(a) establishing maximum upper and lower clock count limits for actuating said sheet feeder, and (b) interrupting operation of said machine in the event said predetermined one clock count following adjustment exceeds one of said maximum upper or lower clock counts.

5. A method of copy sheet feeder adjustment in a reproduction machine having a control means, memory, and a copy sheet feeder for advancing copy sheets in seriatim along a processing path, said control means including count generating means for generating a series of counts for use in operating said machine, said control means actuating said sheet feeder in response to a demand for a copy sheet on a predetermined actuating count, comprising the steps of:

(a) determining the current copy sheet feeding time interval required for said sheet feeder to advance a copy sheet to a predetermined point in said processing path following actuation thereof by said control means;

(b) comparing said current copy sheet feeding time interval with an optimum copy sheet feeding time interval stored in said memory; and (c) adjusting said sheet feeder predetermined actuating count so that said current copy sheet feeding time interval is substantially equal to said optimum copy sheet feeding time interval.

6. The method according to claim 5 inluding the steps of:

(a) recording the count on actuation of said sheet feeder;

(b) recording the count following advance of said copy sheet to said predetermined point in said processing path;

(c) differencing said counts;

(d) comparing the count difference obtained in step c with a count representative of said optimum copy sheet feeding time interval to provide a adjustment count; and (e) adjusting said sheet feeder predetermined actuating count by said adjustment count.

7. The method according to claim 6 including the steps of:

(a) establishing predetermined maximum upper and lower count limits for said sheet feeder predetermined actuating count; and (b) disabling operating of said machine in the event adjusting of said sheet feeder predetermined actuating count causes said sheet feeder predetermined actuating count to exceed said maximum upper or lower count limit.

8. A method for accommodating gradual changes in the operating components of a copy sheet feeder in a reproduction machine of the type which produces copies of originals on copy sheets supplied by said sheet feeder, said reproduction machine including a copy processing path along which said copy sheets are transported when processing copies; memory means for storing operating parameters for actuating the components of said machine including said sheet feeder in selective fashion to produce copies; clock means for generating clock counts for operating said components in predetermined timed relation; and control means for operating said machine to produce copies in accordance with the copy run programmed; said control means actuating said sheet feeder on a predetermined sheet feed clock count to feed copy sheets to said copy processing path; comprising the steps of:

(a) recording the clock count when the copy sheet being fed reaches a preset position;

(b) differencing the count obtained in step a from said sheet feed clock count to provide a difference count representative of the time interval required for said copy sheet to be fed to said preset position;

(c) comparing said difference count with a control count representative of the optimum time interval for said copy sheet to be fed to said present position to obtain a correction count where said difference count is not equal to said control count; and (d) adjusing said sheet feed clock count by said correction count whereby subsequent copy sheets fed by said sheet feeder reach said preset point in said optimum time interval.

* * * * *